United States Patent [19]

Dixon

[11] Patent Number: 4,974,369

[45] Date of Patent: Dec. 4, 1990

[54] TWO-DIMENSIONALLY GROOVED SANDING PAD

[76] Inventor: William Dixon, R.D. #1 Box 318, Lambertville, N.J. 08530

[21] Appl. No.: 545,201

[22] Filed: Jun. 28, 1990

[51] Int. Cl.[5] ..... B24D 15/00; B24D 15/04

[52] U.S. Cl. ..... 51/358; 51/391; 51/407

[58] Field of Search ..... 51/358, 391, 392, 393, 51/382, DIG. 14, 170 TL, 406, 407, 394, 395, 347, 398, 401, 206 P

[56] References Cited

U.S. PATENT DOCUMENTS

| | | | |
|---|---|---|---|
| 1,175,245 | 3/1916 | Dennis | 51/383 |
| 1,595,700 | 8/1926 | Backlind | 51/391 |
| 2,491,510 | 12/1949 | Miller | 51/358 |
| 2,870,581 | 1/1959 | Lyon | 51/170 TL |
| 3,030,742 | 4/1962 | Costello | 51/391 |
| 3,261,049 | 7/1966 | Murphy | 51/358 X |
| 3,892,091 | 7/1975 | Hutchins | 51/391 X |
| 3,900,976 | 8/1975 | Kitts, Jr. | 51/391 X |

*Primary Examiner*—Frederick R. Schmidt
*Assistant Examiner*—Bruce P. Watson
*Attorney, Agent, or Firm*—Kenneth P. Glynn

[57] ABSTRACT

The present invention is directed toward flexible embossed supportive backings for coated abrasives, which are used with "sanding" tools. The supportive backing is made from a flexible elastomeric material embossed on one side with a predetermined pattern. The embossment pattern incudes an uninterrupted narrow border along the edges that lay perpendicular to the primary of travel during use, a plurality of narrow grooves within the border which disrupt the surface area of the elastomeric material, and lines of severance that partially separate the edges of the material from its main body.

The surface acts as the supportive backing for a coated abrasive as it is worked over a roughened surface. The grooves created by the embossment pattern allow the coated abrasive to deform as it encounters high points on a roughened surface, which allows the abrasive to surround the contours of the roughened surface and greatly increases the efficiency of the coated abrasive. The grooves created by the embossment minimizes the work dust trapped between the coated abrasive and the supportive surface, which minimizes high points and uneven results.

17 Claims, 4 Drawing Sheets

TWO-DIMENSIONALLY GROOVED SANDING PAD

BACKGROUND OF THE INVENTION

1. Field of the Invention

The present invention is directed toward a flexible embossed supportive surface for coated abrasives, and more particularly to such devices that allow the user to firmly work a coated abrasive over a roughened surface while allowing for enough independent movement of the coated abrasive to evenly reach all the contours of the roughened surface.

2. Prior Art Statement

Deformable supportive backings used as mediums between tools and coated abrasives have been in existence for decades. In fact, a majority of modern hand and power tool applications of coated abrasives require a supportive backing to assure their effective use. However there are certain disadvantages inherent in all supportive backings. If a supportive surface is flat or overly firm, the supportive surface will not allow the coated abrasive to follow all the contours of a roughened surface. This retards the effectiveness of the abrasive and results in the need of additional work to smooth a roughened area. If a supportive surface is too soft, the surface allows for slippage and buckling of the coated abrasive which greatly decreases its working life. Prior art has addressed this problem in several ways. The most common way is to emboss voids onto the surface of a flexible but firm material. This approach has been used for a hundred years and is exemplified by U.S. Pat. Nos. 1,175,245 to Dennis, and 1,595,700 to Backland. Both patents show an embossed surface in their drawings but fail to address the advantages represented by such configurations. The advantages of such embossing are that a firm material can be used to support the coated abrasive and that the deformation allowed by the embossed voids increase the efficiency of the coated abrasive. The disadvantages of such embossed configurations is that the firm embossed surface, although an advantage over a soft solid surface, still allows the coated abrasive to bind, bend and fold when worked across a roughened area especially along the working edges of such backings.

Alternate approaches were developed to eliminate these inherent embossed supportive surface problems. They are exemplified in U.S. Pat. Nos. 3,900,976 to Kitts and 3,892,091 to Hutchins. The Kitt Patent addressed the bending and folding coated abrasive problem by creating a supportive backing that is covered with suction cups. The suction cups adhere to the back of the coated abrasives and prevent bending and folding of the coated abrasive. The Hutchins Patent approached the problem by using an adhesive abrading sheet in conjunction with an embossed surface. The bending and folding of the abrasive sheet was eliminated by the adhesive interplay of the supportive surface and the abrasive sheet.

Thus, prior art does show us that there are inherent problems with supportive backings to coated abrasives and that solutions to these problems have been pursued for a century. However, the prior art does not teach nor suggest the unique approach to these problems addressed by the present invention herein.

SUMMARY OF THE INVENTION

The present invention is directed towards flexible embossed supportive backings for coated abrasives, which are used as mediums between coated abrasives and handheld or power operated tools. The supportive backing is made from a flexible elastomeric material that is embossed on one side with a predetermined pattern. The embossment pattern allows for the creation of at least two undisrupted narrow borders on the edges of the supportive backing that lay perpendicular to the direction which the supportive backing is worked. Additionally, the embossment pattern creates a plurality of narrow grooves within the border that disrupt the surface area of the elastomeric material. The undisrupted narrow borders of the supportive backing are separated from the embossment pattern by a line of severance. The line of severance transcends the material of the supportive backing at least as deeply as the voids created by the embossment pattern and travels the full length of the bordered edge. Lines of severance also run parallel to the non-bordered edges of the supportive backings, a predetermined distance in from the edge. The lines of severance disrupt the embossment pattern and create embossed edges that can move independently from the rest of the embossed surface. The partially bordered, grooved embossed surface acts as the supportive backing for a coated abrasive as it is worked over a roughened surface the grooves created by the embossment pattern allow the coated abrasive to deform as it encounters high points on a roughened surface. The deformation of the coated abrasive allows the abrasive to surround the contours of the roughened surface and greatly increases the efficiency of the coated abrasive as compared to an application with a solid supportive surface. Additionally, the grooves created by the embossment prevents work dust from the abrasive from being trapped between the coated abrasive and the supportive surface. This allows the coated abrasive to pass over a worked surface evenly without dust causing high points in the coated abrasive and uneven results.

The present supportive backing invention has all the advantages of traditional embossed backings and additionally embodies an orientation of design that extends the life and efficiency of a coated abrasive by preventing bends, folds and tears. The present invention supportive backing's orientation of design holds the circumferential points of the coated abrasive against the working surface preventing any bending or folding of the coated abrasive. This improved embossment design improves the life and efficiency of the coated abrasive and allows the user to get results, previously obtainable with only fine grit abrasives, with larger medium grit abrasives.

BRIEF DESCRIPTION OF THE DRAWINGS

The invention will be more fully understood by referring to the following detailed specifications the above specification and claims set forth herein, when taken in connection with the drawings hereto, wherein:

DETAILED DESCRIPTION OF THE PRESENT INVENTION

Figure 1:
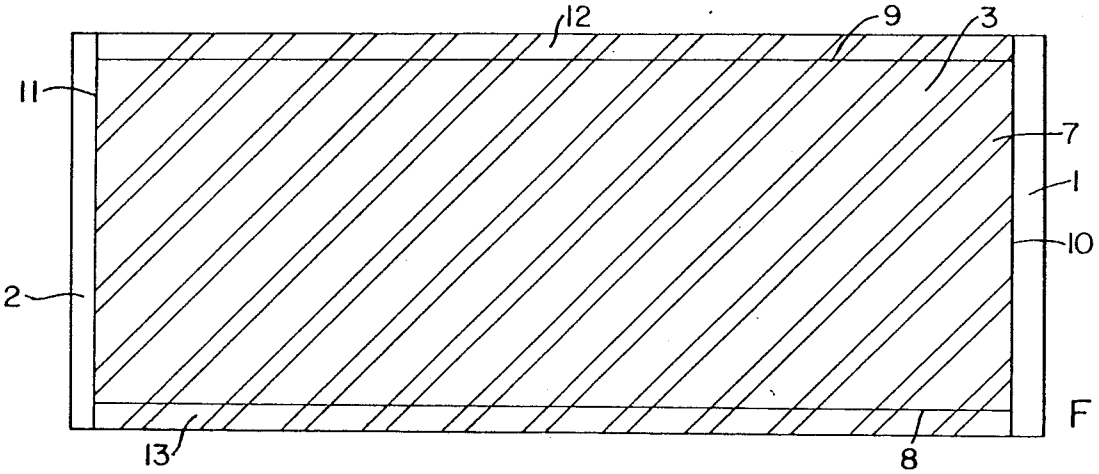
FIG. 1 shows the bottom view of one preferred embodiment of the present invention.

The present invention is, as mentioned, directed toward a flexible embossed supportive surface for coated abrasives. Such supportive surfaces have long been needed to act as mediums between coated abrasives and tools that use such. Most tools are hard and stiff, and if a coated abrasive were mounted directly to such a tool, the coated abrasive would not be given the ability to deform as it passed over a roughened surface. If no deformation is allowed, the coated abrasive will only affect the high points on a roughened surface, and the effectiveness and efficiency of the coated abrasive will be greatly reduced. To eliminate this problem, flexible supportive surfaces are used with tools, to act as mediums between the hard tool and the coated adhesive. The softer the supportive surface is created, the greater the deformation of the coated abrasive is allowed as it engages a roughened surface. Such soft supportive surfaces do allow for a greater effectiveness of the coated abrasive, but also result in new negative characteristics. Roughened surfaces usually are fairly hard, and as a result, if a coated abrasive was used with a soft supportive surface, the roughened surface tends to catch the coated abrasive as it is worked over the roughened area. The coated abrasive binding on the roughened surface causes the abrasive to buckle, fold or tear. As a result, when a soft supportive surface is used, the working life expectancy of the coated surface is greatly reduced and the coated abrasive requires frequent replacement. Additionally, the soft supportive surfaces themselves tend to tear and wear quickly in the abrasive environment of their use.

Most coated abrasive tool manufacturers are well aware of the problems inherent in supportive backings to avoid these problems many configurations of supporting backings have been developed. The two most common types of coated adhesive backings are solid backings of medium flexibility or firm backings with embossed grooving. Solid backing of medium flexibility combine the features of soft and firm backings in an attempt to minimize the negative characteristics of each. Usually the negative characteristics are minimized by this combination approach but consequently the positive characteristics are also compromised and the resulting supportive backing is far from ideal. The coated abrasive still binds and dust created by the coated abrasive tends to gather between the flat supportive backing and the coated abrasive. The trapped dust gathers together and deforms the coated abrasive giving uneven results as it is worked over a roughened surface.

Flexible but firm embossed supportive backings also minimize the inherent problems of use with coated backings. Embossed surfaces are usually relatively firm to give good support to a coated abrasive. However the working surface of the backing is embossed with a pattern that creates voids in its surface area. The coated abrasive lays over these voids and allows the coated abrasive to deform when it is passed over a roughened area. This embossed orientation provides both a firm and soft support needed for the effective use of a coated abrasive.

Adversely, embossed surfaces also have their faults. Since the voids on the supportive backing of the coated abrasive allow for only periodic deformations of the abrasive, the finish produced by it on a worked surface can have lines and waves in it. Also, the voided edges along the perimeter of the supportive backing creates areas where the coated abrasive can easily fold, buckle or tear. As such great care must be taken with such backings to ensure professional results.

The present invention addresses the concerns of coated abrasive supportive backings in a unique manner. The present invention uses a flexible elastomeric backing material that is embossed with a pattern that offers benefits above all other existing backings. The present invention supportive backing includes a solid uninterrupted border along its edges that lay essentially perpendicular to the direction in which the supportive backing is worked. The bordered edges envelope an embossed area. The border level is on a plane equal to the highest point of the embossed area, ensuring that the border is always the first surface that the coated abrasive encounters. The embossed area within the border is cut with grooves. The grooves traverse a depth into the supportive backing but do not fully pierce the material. The partial penetration of the embossed grooves assures that the backing material maintains its original stiffness and allows for easier adhesion to tools. The solid borders are separated from the embossed area by a line of severance. The line of severance transcends the supportive backing material a depth equal to or greater than the voids created by the embossment and travels the full length of the bordered edge. Other lines of severance travel parallel to the non-bordered edges of the supportive backing. These lines of severance travel a predetermined distance in from the non-bordered edges and sever the existing embossed pattern between the bordered edges. The disruption of the embossment pattern creates embossed borders along the edges of the supportive backing that can move independently from the rest of the embossed surface. The benefits of this embossment and edge configuration is three fold. First, the solid borders of the embossed surface ensures that the circumferential working edges of a coated abrasive is always in contact with the supportive backing. This constant contact perpendicular to the direction of work eliminates the traditional problems of the coated abrasive tearing or binding along the primary edge areas of traditional backings. Additionally, the solid perpendicular borders eliminate the lines and waves in the worked finish that were prevalent with other embossed backings with only periodic areas of circumferential support. Second, the independent movement of the embossed edges allow for greater resiliency and eliminate the line and waves in the worked finish caused by any sideways movements of the coated abrasive.

The third advantage of the embossed configuration of the present invention is that its embossed area provides room for dust to collect. Coated abrasives, by nature, produce dust as they are worked over roughened areas. This dust builds up between the coated abrasive and the solid supportive backing or backing with small embossments, and can create high points in the coated abrasive that will result in an uneven finish. The present invention's embossment provides room for this dust to collect without affecting the coated abrasive thus eliminating the problem inherent with solid backings.

The present invention has the benefits of all prior solid and embossed supportive surfaces while eliminating the negative characteristics that affect performance. As a result, coated abrasives used with the present invention backing are more effective and efficient than with any other prior backing. Experiments performed with the present invention backing and compared with prior art backs confirm the results. When compared with other embossed backings, the present invention backing provided smoother results in the same time. Additionally, the coated abrasive used lasted longer than the identical abrasive sheet used with the traditional embossed surface. When compared with a traditional solid backing, the present invention gave better results than the solid backing and achieved those results in less time. In both experimental comparisons the present invention backing the efficiency and effectiveness was so enhanced over the traditional backings, that a finer grade of coated abrasive can be used with the present invention backing and it will match or surpass the smoothness in results of traditional backings using coarser grit abrasives.

Figure 2:
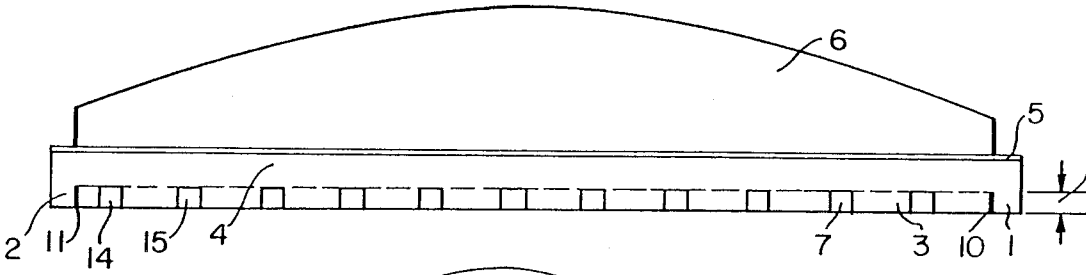
FIG. 2 shows a side view of the preferred embodiment represented in FIG. 1.
Figure 3:
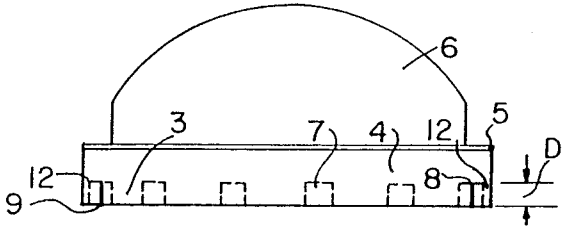
FIG. 3 shows a front view of the preferred embodiment represented in FIGS. 1 and 2.

Referring now to FIGS. 1, 2, and 3 there are shown the respective bottom, side and front views of one preferred embodiment of the present invention. The embodiment consists of a shaped piece of elastomeric material 4, having a pattern 3 embossed between two solid parallel edge borders 1 and 2. The embossed pattern 3 creates voids 7 that travel within the left border 2 and the right border 1, and transgresses a depth D into the elastomeric material 4. The left solid border 2 is separated from the embossed pattern 3 by a line of severance 11, that runs along on edge of the left solid border 2. Similarly the right solid border 1 is separated from the embossed pattern 3 by a line of severance 10 that runs along its edge. Both the left line of severance 11 and the right line of severance 10 transgresses the elastomeric material 4 a depth D, and travel the full length of the solid border edges 1 and 2. Two additional lines of severance, an upper line 9 and a lower line 8, travel perpendicular to, and are encompassed by, the parallel left and right solid borders 10 and 11. The upper line of severance 9 separates a narrow region 12 within the embossed pattern 3. similarly the lower line of severance 8 separates a narrow region 13 within the embossed pattern 3. The upper and lower lines of severance 8 and 9 allow for the independent movement of the upper and lower narrow regions 12 and 13 in relation to each other and the main body of the embossed pattern 3. The side of the elastomeric material 4 that is not embossed is so created and formed to be attached to bottom or baseplate 5 of a tool 6, that works coated abrasive. The left and right solid edge borders 1 and 2 are so positioned as to be perpendicular to the primary direction of movement of the tool 6 over a roughened surface.

Figure 4:
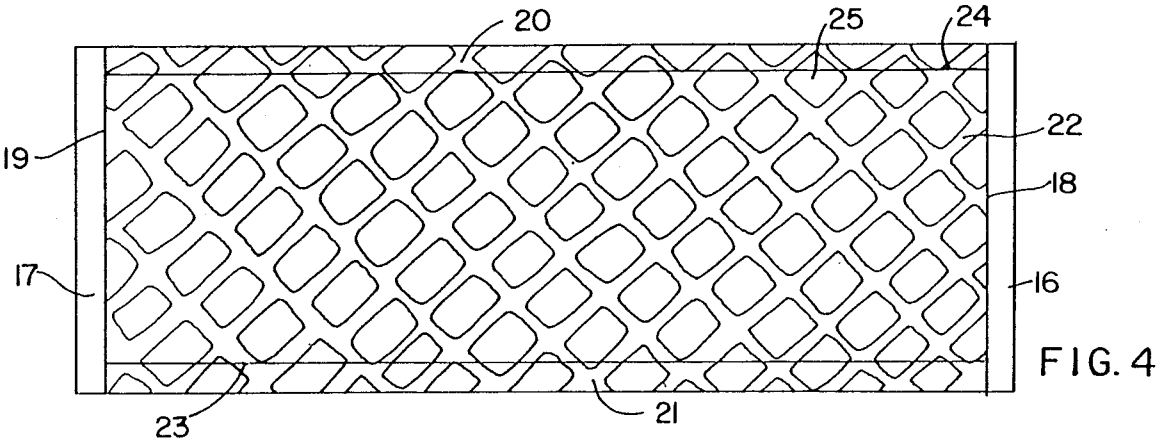
FIG. 4 shows the bottom view of one preferred embodiment of the present invention.
Figure 5:
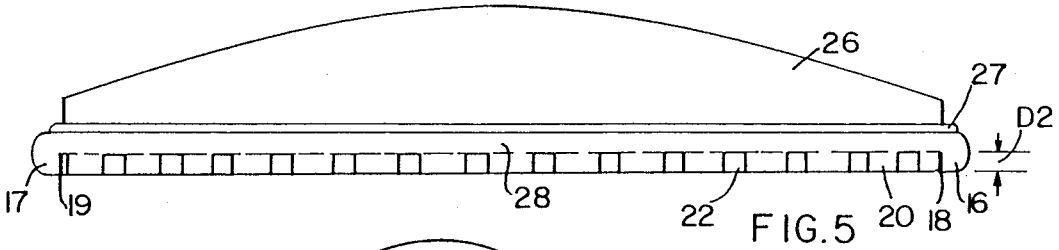
FIG. 5 shows a side view of the preferred embodiment represented by FIG. 4.
Figure 6:
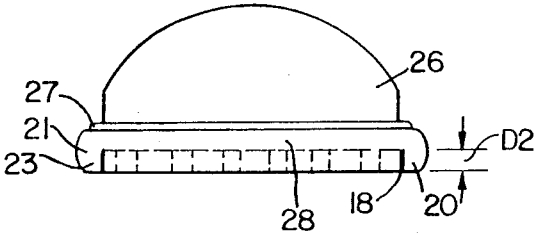
FIG. 6 shows a front view of one preferred embodiment represented by FIGS. 4 and 5.

FIGS. 4, 5 and 6 mimic the configurations of FIGS. 1, 2 and 3 respectively but do so showing an alternate embodiment of the embossed pattern 25 within the elastomeric material 28. Again the embossed pattern 25 is encompassed between two solid borders 16 and 17, and the solid borders 16 and 17 are separated from the embossed pattern 25 by two lines of severance 19 and 18 respectively. Also, the upper 20 and the lower 21 edges of the embossed pattern 25 are separated from the main body of the embossed pattern by an upper 24 and lower 23 line of severance respectively. All the lines of severance, upper 24, lower 23, left 19 and right 18 transgress a depth D2 into the elastomeric material 28, the depth D2 being equal to the depth of the grooves 22 created by the embossed pattern 25.

Figure 7:
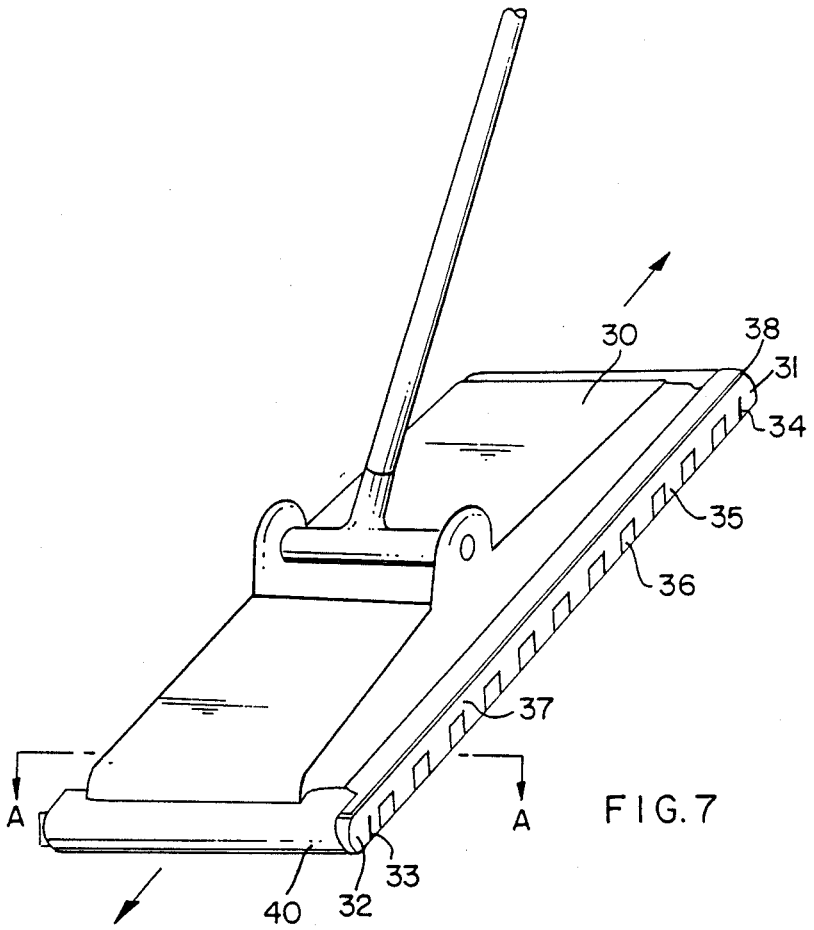
FIG. 7 shows an oblique view of one preferred embodiment of the present invention as incorporated within a common flat hand tool.
Figure 8:
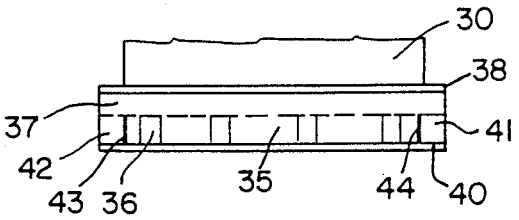
FIG. 8 shows a cross section view of the preferred embodiment of FIG. 7 cut along section line second A—A.

FIG. 7 shows an oblique view of one preferred embodiment of the present invention as it would be incorporated into a handtool 30. This Figure along with FIG. 8, which is a cross-section of FIG. 7 cut along line A—A, best illustrate the interworkings between the base of the tool 38, the elastomeric material 37, the embossed pattern 35 and the coated abrasive 40. The coated abrasive 40 is folded over the solid borders 32 and 31 of the present invention. This orientation assures that the solid borders 31 and 32 are the first surface to support the coated abrasive 40 as it is worked over a roughened surface. The lines of severance 33 and 34 that respectively separate the solid edge borders 32 and 31, ensure that the solid borders 32 and 31 can move independently from the embossed pattern 35 and can firmly give support along the primary working edges of coated abrasive 40. The rest of the coated abrasive 40 is supported by the embossed pattern 35, and the grooves 36 within embossed pattern 35 gives the coated abrasive 40 the flexibility it needs to surround high points on a roughened surface. To prevent the grooves 36 from permitting the coated abrasive to rip along its edges, the side surfaces of the embossed pattern 41 and 42 are separated from the main embossed pattern by their respective lines of severance 43 and 44. These lines of severance, 43 and 44, allow the edges 41 and 42 of the embossed surface to move independently. This independent movement relieves stress to the coated abrasive 40 along its supportive edges and minimized rips and tears.

Figure 9:
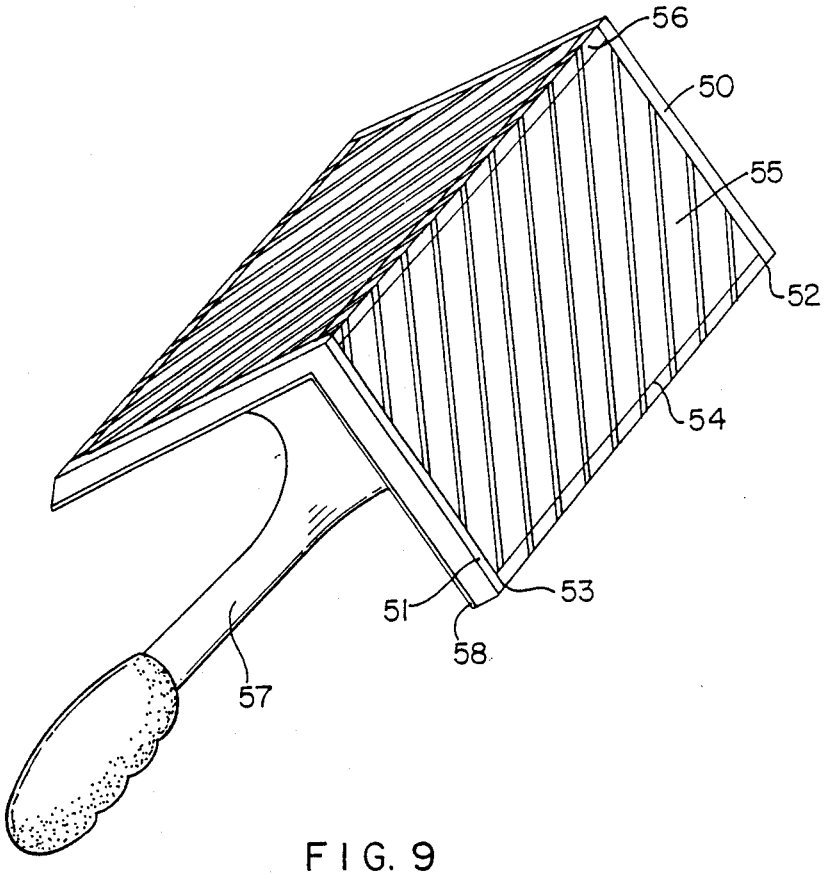
FIG. 9 shows an oblique view of one preferred embodiment of the present invention as incorporated within a cornering hand tool.

FIG. 9 shows a different preferred embodiment of the present invention. FIG. 9 is an oblique view of a handtool 57 that is shaped to work a coated abrasive against a corner. This figure shows the variety at which the embossment pattern 55 can be created and the variety of handtools on which the present invention can be applied. Additionally, FIG. 9 best shows how the solid border edges 50 and 51 are separated from the embossment pattern 55 and how the lines of severance 52, 53, 54 and 56 separate the edges of the present invention from the main body allowing for the free independent movement of each edge.

As shown from FIGS. 1–9, the shape of the elastomeric material can conform to the base of any known or future tool that works a coated abrasive. Additionally the embossed pattern can be of any configuration and need not be the geometrical shapes shown in the figures. Also, numerous configurations, and materials can be used in varied forms of the present invention. It is therefore understood that within the scope of the appended claims, the invention may be practiced otherwise than is specifically described within.

What is claimed is:

1. In a resilient supportive backing for a coated abrasive, the improvement which comprises:

(a) a shaped area of elastomeric material embossed on one side with a predetermined pattern, where said embossment does not transgress the depth of the said elastomeric material;

(b) A continuous solid border, created by the absence of embossment, running along all the edges of said embossed side of said elastomeric material that lay perpendicular to the primary direction of travel of said supportive backing during use;

(c) A line of severance separating said solid bordered edges from said embossed areas and traveling the full length of said solid bordered edge;

(d) A line of severance running a predetermined distance from, and parallel to, all the edges of said embossed side of said elastomeric material that do not lay perpendicular to the primary direction of travel of said supportive backing during use, said lines of severance running between said solid bordered edges, and;

(e) A plurality of narrow groves created by said embossment.

2. The backing device of claim 1 wherein said narrow grooves are between $\frac{1}{8}$ inches and $\frac{1}{2}$ inches in width.

3. The backing device of claim 1 wherein said narrow solid borders are between $\frac{1}{8}$ inches and $\frac{1}{2}$ inches in width.

4. The backing device of claim 1 wherein said narrow grooves transgress a depth approximately 20% to 80% the height of said elastomeric material.

5. The backing device of claim 1 wherein said narrow grooves transgress a depth approximately 40% to 80% the height of said elastomeric material.

6. The backing device of claim 1 wherein said lines of severance transgress a depth into said elastomeric material at least equal to the depth of said narrow grooves.

7. The backing device of claim 1 wherein at least two said grooves intercept each square inch of the embossed surface between said solid edges.

8. The backing device of claim 1 wherein said narrow grooves are between $\frac{1}{4}$ inches and $\frac{3}{8}$ inches in width.

9. The backing device of claim 1 wherein said narrow solid borders are between $\frac{1}{4}$ inches and $\frac{3}{8}$ inches in width.

10. The backing device of claim 1 wherein said predetermined distance between said line of severance and said nonbordered edge is between $\frac{1}{8}$ inches and $\frac{1}{2}$ inches.

11. The backing device of claim 1 wherein said predetermined distance between said line of severance and said nonbordered edge is between $\frac{1}{4}$ inches and $\frac{3}{8}$ inches.

12. The backing device of claim 1 wherein said narrow groves run parallel within said embossed pattern.

13. The backing device of claim 1 wherein said narrow grooves intersect.

14. The backing device of claim 1 wherein said narrow grooves transgress a depth of approximately 50% the height of said elastomeric material.

15. The backing device of claim 14 wherein said narrow grooves intersect at an obtuse angle.

16. The backing device of claim 14 wherein said narrow grooves intersect at an acute angle.

17. The backing device of claim 14 wherein said narrow grooves intersect at a right angle.

* * * * *